US010765219B1

(12) United States Patent
Cabble et al.

(10) Patent No.: US 10,765,219 B1
(45) Date of Patent: Sep. 8, 2020

(54) LOUNGER HAVING A PNEUMATIC LOUNGING SYSTEM

(71) Applicant: KA Group AG, Zürich (CH)

(72) Inventors: Brian Cabble, Berkley, MI (US); Cha Xiong, Warren, MI (US)

(73) Assignee: KA GROUP AG, Zurich (CH)

( * ) Notice: Subject to any disclaimer, the term of this patent is extended or adjusted under 35 U.S.C. 154(b) by 0 days.

(21) Appl. No.: 16/386,773

(22) Filed: Apr. 17, 2019

(51) Int. Cl.

| | |
|---|---|
| ***A47C 4/54*** | (2006.01) |
| ***A47C 7/46*** | (2006.01) |
| ***A61H 15/00*** | (2006.01) |
| ***A61H 23/04*** | (2006.01) |

(52) U.S. Cl.
CPC ..... *A47C 7/467* (2013.01); *A61H 15/0078* (2013.01); *A61H 23/04* (2013.01); *A61H 2201/0103* (2013.01); *A61H 2201/0138* (2013.01); *A61H 2201/1238* (2013.01); *A61H 2205/081* (2013.01)

(58) Field of Classification Search
CPC ..... B60N 2/914; B60N 2/665; B60N 2/66; B60N 2/976
See application file for complete search history.

(56) References Cited

U.S. PATENT DOCUMENTS 3,201,111 A * 8/1965 Afton ..... A61H 9/0078 267/153
4,524,762 A * 6/1985 Schulman ..... A61G 7/0573 297/284.1
5,816,653 A * 10/1998 Benson ..... B60N 2/6671 297/284.4
6,159,172 A * 12/2000 Gray ..... A61G 5/1043 297/452.41
6,203,105 B1 * 3/2001 Rhodes, Jr. ..... A47C 4/54 297/284.6
6,206,474 B1 * 3/2001 Kruse ..... B60N 2/70 297/452.41
6,212,719 B1 * 4/2001 Thomas ..... A47C 4/54 297/284.6
6,682,059 B1 * 1/2004 Daniels ..... A47C 4/54 267/131
7,506,389 B2 * 3/2009 Zheng ..... A47C 4/54 297/452.41
2003/0038517 A1 * 2/2003 Moran ..... B60N 2/914 297/284.3
2004/0174056 A1 * 9/2004 Gryp ..... B60N 2/4221 297/284.6

(Continued)

*Primary Examiner* — Shin H Kim
(74) *Attorney, Agent, or Firm* — Cantor Colburn LLP

(57) ABSTRACT

A pneumatic lounging system includes an inflatable support unit and an inflatable unit. The inflatable support unit includes an inward layer, an outward layer, and a support air nozzle. The inward layer and the outward layer define an air cavity, and the outward layer is attached to the inward layer. The support air nozzle is attached and adapted to provide direct fluid communication of air with the air cavity. The inflatable unit includes an inward wall, an outward wall, and an air nozzle. The inward wall and the outward wall define at least one air chamber, and the inward wall is attached to the outward layer. The air nozzle is adapted to provide direct fluid communication of air with one of the at least one air chamber. There is no fluid communication between the inflatable support unit and the first inflatable unit.

20 Claims, 3 Drawing Sheets

(56) References Cited

U.S. PATENT DOCUMENTS

| | | | | |
|---|---|---|---|---|
| 2006/0049678 | A1* | 3/2006 | Kern | B60N 2/914<br>297/284.3 |
| 2006/0217644 | A1* | 9/2006 | Ozaki | A61H 9/0078<br>601/148 |
| 2008/0277985 | A1* | 11/2008 | Petzel | B60N 2/4415<br>297/284.6 |
| 2010/0244504 | A1* | 9/2010 | Colja | A61H 9/0078<br>297/180.1 |
| 2013/0187419 | A1* | 7/2013 | Worlitz | B60N 2/976<br>297/217.1 |

* cited by examiner

LOUNGER HAVING A PNEUMATIC LOUNGING SYSTEM

INTRODUCTION

The subject disclosure relates to a lounger, and more particularly, to a seat including a pneumatic lounging system.

Loungers, such as automotive seats, are designed to provide occupant support and massage capability. Some known designs include pneumatic systems that provide such capability, however, configuration and distribution of the system upon the seat is restrictive and limiting.

Accordingly, it is desirable to design a pneumatic lounging system with greater design flexibility and/or versatility.

SUMMARY

A pneumatic lounging system according to one exemplary embodiment of the present disclosure includes an inflatable support unit and a first inflatable unit. The inflatable support unit includes an inward layer and an outward layer defining an air cavity. The outward layer is attached to the inward layer. The support air nozzle is attached and adapted to provide direct fluid communication of air with the air cavity. The first inflatable unit includes an inward wall, an outward wall, and an air nozzle. The inward and outward walls are define at least one air chamber and the inward wall is attached to the outward layer. The air nozzle is adapted to provide direct fluid communication of air with one of the at least one air chamber. The fluid communication of air with the air cavity is independent of the fluid communication of air with the at least one air chamber.

Additionally to the foregoing embodiment, the first inflatable unit includes a plurality of stacked air cells each including an inward wall and an outward wall. The inward and outward walls of each air cell define an air chamber. A least one orifice is adapted to provide fluid communication between respective chambers of adjacent air cells of the plurality of stacked air cells.

In the alternative, or additionally thereto, in the foregoing embodiment, each orifice of the at least one orifice includes a first inner perimeter defining an opening in an outward wall of an inward air cell, and a second inner perimeter defining an opening in an inward wall of an adjacent outward air cell. The first and second perimeters are attached, and the openings are aligned, to provide fluid communication between the inward and outward air cells.

In the alternative, or additionally thereto, in the foregoing embodiment, the first inflatable unit is accordion-like.

In the alternative, or additionally thereto, in the foregoing embodiment, the first inflatable unit is a first inflatable massage unit.

In the alternative, or additionally thereto, in the foregoing embodiment, an outer perimeter segment of the inward wall and an outer perimeter segment of the outward wall of each air cell of the plurality of air cells are attached forming a continuous outer perimeter seam.

In the alternative, or additionally thereto, in the foregoing embodiment, an outer perimeter portion of the inward layer and an outer perimeter portion of the outward layer are attached forming an outer perimeter layer seam.

In the alternative, or additionally thereto, in the foregoing embodiment, an outer perimeter segment of the inward wall and an outer perimeter segment of the outward wall of each air cell of the plurality of air cells are attached forming an outer perimeter wall seam.

In the alternative, or additionally thereto, in the foregoing embodiment, the outer perimeter layer seam is sonic welded, and the inward and outward layers are made of resiliently pliable plastic.

In the alternative, or additionally thereto, in the foregoing embodiment, further comprising a second inflatable unit including an inward wall, an outward wall, and an air nozzle. The inward wall and the outward wall define at least one air chamber, and the inward wall is attached to the outward layer. The air nozzle is adapted to provide direct fluid communication of air, with one of the at least one air chamber. There is no fluid communication between the inflatable support unit and the second inflatable unit.

In the alternative, or additionally thereto, in the foregoing embodiment, the first and second inflatable units are inflatable massage units.

In the alternative, or additionally thereto, in the foregoing embodiment, the inflatable support unit is a shoulder support unit and the first and second inflatable massage units are left and right side massage units.

In the alternative, or additionally thereto, in the foregoing embodiment, further comprising an automotive seat structure adapted to support the inflatable support unit.

An automotive seat according to another embodiment includes a seat structure, an inflatable support unit, and a first inflatable unit. The inflatable support unit is adapted to adjustably support at least one of a lumbar, a neck, and a shoulder. The first inflatable unit includes an inward wall, an outward wall, and an air nozzle. The inward wall and an outward wall define at least one air chamber and the inward wall is directly attached to the inflatable support unit. The air nozzle is adapted to provide, direct fluid communication of air with one of the at least one air chamber. There is no fluid communication between the inflatable support unit and the first inflatable unit.

Additionally to the foregoing embodiment, the automotive seat further includes a second inflatable unit laterally spaced from the first inflatable unit. The second inflatable unit includes an inward wall, an outward wall, and an air nozzle. The inward and outward walls define at least one air chamber, and the inward wall is directly attached to the inflatable support unit. The air nozzle is adapted to provide direct fluid communication of air with, one of the at least one air chamber, wherein there is no fluid communication between the inflatable support unit and the second inflatable unit.

In the alternative, or additionally thereto, in the foregoing embodiment, the first and second inflatable units are massage units.

In the alternative, or additionally thereto, in the foregoing embodiment, the inflatable support unit is an adjustable shoulder support unit. The first inflatable massage unit is generally a left shoulder massage unit. The second inflatable massage unit is generally a right shoulder massage unit.

In the alternative, or additionally thereto, in the foregoing embodiment, the first and second inflatable units are each accordion-like including a plurality of stacked air cells each defining an air chamber. At least one orifice is positioned between adjacent air cells of the plurality of stacked air cells for fluid communication between chambers.

In the alternative, or additionally thereto, in the foregoing embodiment, the plurality of stacked air cells include an inward air cell attached to the inflatable support unit, and an outward air cell attached to and in fluid communication with the inward air cell.

In the alternative, or additionally thereto, in the foregoing embodiment, the inflatable support unit includes an inward layer, an outward layer and a support air nozzle. The inward and outward layers define an air cavity. The support air nozzle is in fluid communication with the air cavity for the flow of air. The inward walls of each one of the first and second inflatable units are attached to the outward layer.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
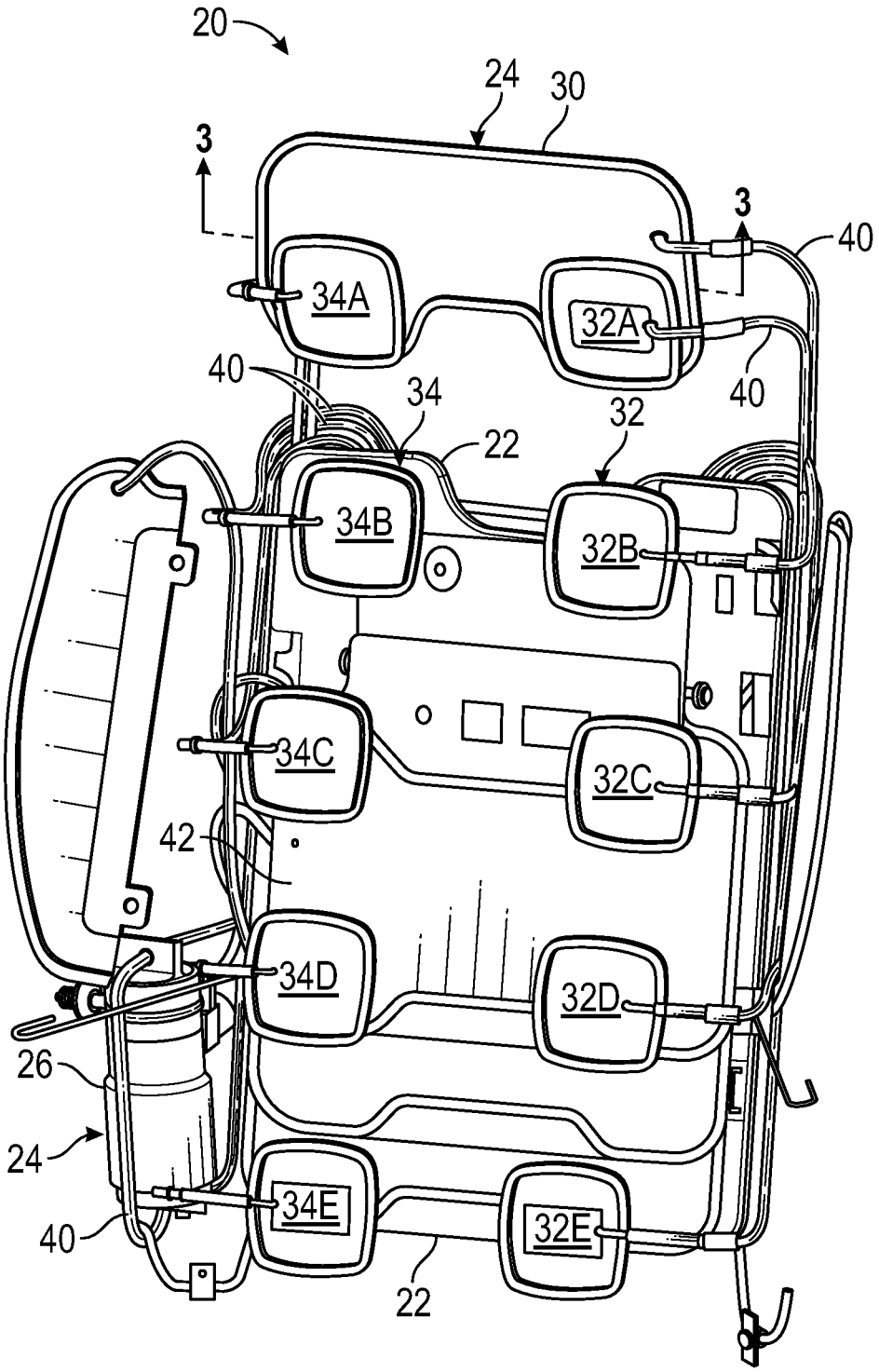
FIG. 1 is a partial front view of a lounger illustrated as an automotive seat and with portions removed to show portions of a pneumatic lounging system of the lounger.

The following description is merely exemplary in nature and is not intended to limit the present disclosure, its application or uses. It should be understood that throughout the drawings, corresponding reference numerals indicate like or corresponding parts and features.

In accordance with an exemplary embodiment, FIG. 1 illustrates a portion of a lounger, or seat, 20. The seat 20 includes a seat back support structure 22 and a pneumatic lounging system 24. In one example, the lounger or seat 20 may be an automotive seat. In other applications, the lounger may be a recliner, a couch, an office chair a bed, or any other device or furniture having ergonomic attributes and wherein a user may lounge.

In one embodiment, the pneumatic lounging system 24 is attached to, and at least in-part, is supported by, the seat back support structure 22. In one example, the system 24 includes at least one compressor 26 (i.e., air pump), at least one series, or banks, of valves (i.e., illustrated as two banks of valves 28A, 28B, see FIG. 2), at least one inflatable support unit 30, inflatable massage units (i.e., illustrated as two pluralities of inflatable massage units 32, 34, see FIG. 1) and a controller 35. In another embodiment, the pneumatic lounging system 24 may also be supported by, or exclusively supported by a base portion (i.e., a base structure) of the seat 20 (not shown) for ergonomically supporting and/or massaging the legs of an occupant. It is contemplated and understood that the banks of valves 28A, 28B may be sorted in any variety of other ways, and located in any variety of locations including remotely from the seat 20. In this and other embodiments, the inflatable massage units 32, 34 may be generally referred to as "inflatable units" adapted to provide any variety of functions that may, or may not, include massaging.

Figure 2:
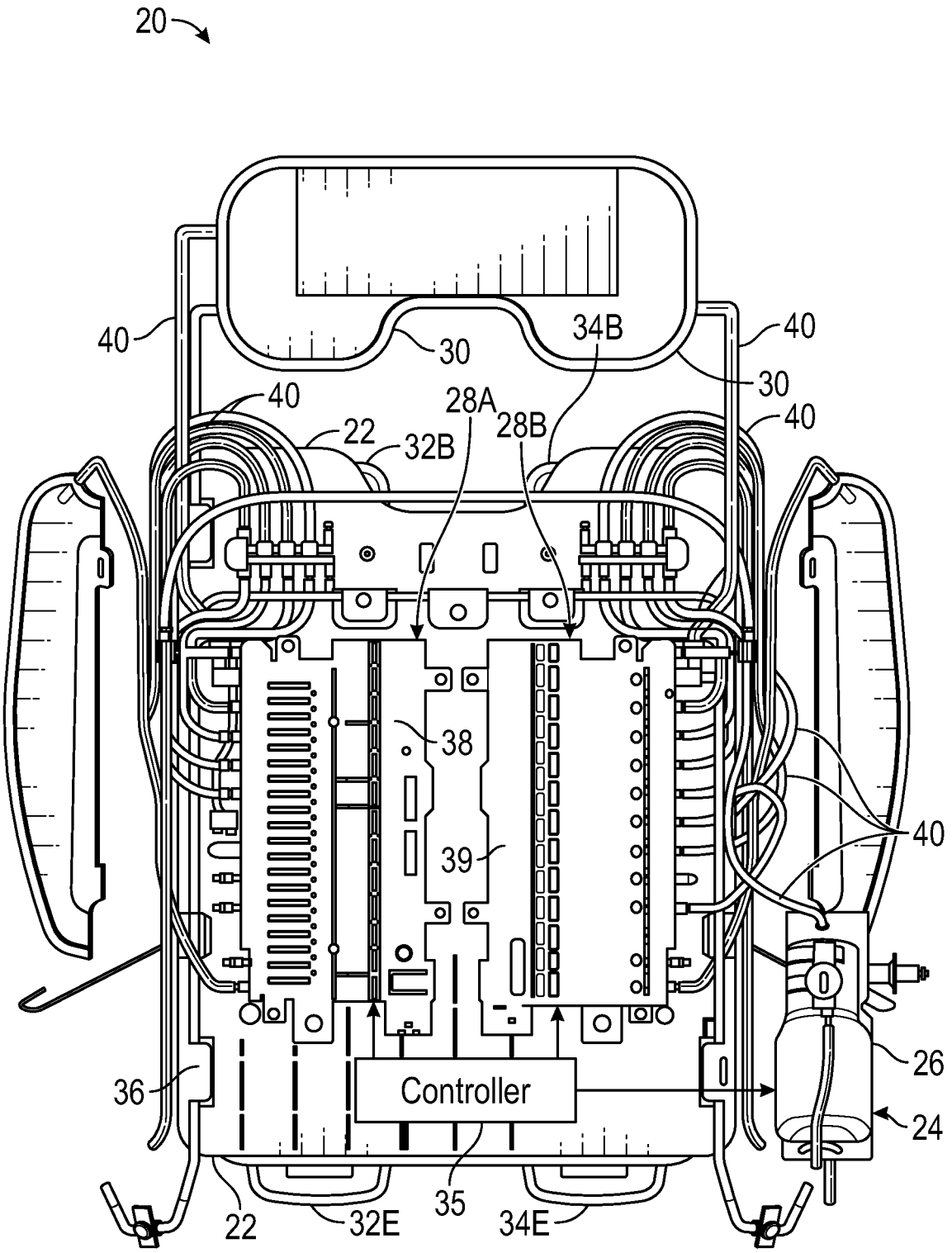
FIG. 2 is a partial back view of the lounger with portions removed to show portions of the pneumatic lounging system.

Referring to FIG. 2, the valves 28A, 28B may be supported at a rear side 36 of the seat structure 22. The bank of valves 28A are contained within a common housing 38 at a left side of the rear side 36, and the bank of valves 28B are contained within a common housing 39 at a right side of the rear side 36. Referring to FIG. 1, the inflatable support unit 30 is located at, and may be supported by, a front side 42 of the structure 22. In one embodiment, the inflatable support unit 30 is generally located proximate to shoulder height of the occupant when seated. That is, the support unit 30 is located directly upon the front side 42 to support an upper thoracic region of the occupant. The inflatable support unit 30 may generally span from left to right, so that a single support unit 30 (i.e., having a single air chamber) can support both sides (i.e., left and right sides) of the upper thoracic region. It is further contemplated and understood that the inflatable support unit 30 may be located in other areas to ergonomically support other regions of the human body.

In one embodiment, the inflatable massage units 32 (i.e., five illustrated in FIG. 1 as 32A, 32B, 32C, 32D, 32E) are generally located at the front side 42 of the back support structure 22, and are vertically aligned and spaced from one another. The massage unit 32A is directly attached to, and supported by a left portion of the inflatable support unit 30. The massage units 32B, 32C, 32D, 32E are spaced vertically beneath the massage unit 32A and the support unit 30, and may be directly attached and supported by the back support structure 22.

The inflatable massage units 34 (i.e., five illustrated in FIG. 1 as 34A, 34B, 34C, 34D, 34E) are generally located at the front side 42 of the back support structure 22, and are vertically aligned and spaced from one another. The massage unit 34A is directly attached to, and supported by a right portion of the inflatable support unit 30, and thus spaced right of the inflatable massage unit 32A (i.e., laterally spaced from inflatable massage unit 32A). The massage units 34B, 34C, 34D, 34E are spaced vertically beneath the massage unit 34A and the support unit 30, and may be directly attached and supported by the back support structure 22.

When assembled, the inflatable massage units 32, 34 are spaced horizontally apart from one-another. In one embodiment, the inflatable massage units 32A, 32B and inflatable massage units 34A, 34B massage the upper thoracic region of the occupant at respective left and right areas of the region. The inflatable massage units 32C, 32D, 32E and inflatable massage units 34C, 34D, 34E massage a lower thoracic region of the occupant at respective left and right areas of the region.

The compressor 26 may be supported by the structure 22 and also located at the rear side 34, or alternatively, may be remotely located and/or located beneath the seat 20. A plurality of conduits 40 for the flow of air are routed between the banks of valves 28A, 28B, the inflatable massage units 32A-E and massage units 34A-E, the inflatable support unit 30 and the compressor 26. More specifically, the compressor 26 provides compressed air directly to the banks of valves 28A, 28B via conduits 40 that may be dedicated for each bank. The bank of valves 28A may include a dedicated valve for each inflatable massage unit 32A-E with dedicated conduits 40 routed to the respective inflatable massage units. Similarly, the bank of valves 28B may include a dedicated valve for each inflatable massage unit 34A-E with dedicated conduits 40 routed to the respective inflatable massage units. Yet further, one of the banks of valves 28A, 28B, or a separate valve, may include a valve dedicated for the inflatable support unit 30.

The controller 35 is configured to control the compressor 26 and the banks of valves 28A, 28B to controllably inflate and/or deflate the inflatable massage units 32, 34 and the inflatable support unit(s) 30 at controlled rates, flows and/or pressure. The controller 35 is an electronic controller and may include one or more processor (e.g., microprocessors) and one or more computer storage mediums that may be non-transitory. In one embodiment, the controller 35 may be one or more application specific integrated circuits (ASIC), with an ASIC dedicated and integrated into each valve, or bank of valves. In other embodiments, the controller 35 may be attached to the back side 36 of the support structure 22, and generally adjacent to the banks of valves 28A, 28B (see FIG. 2).

Figure 3:
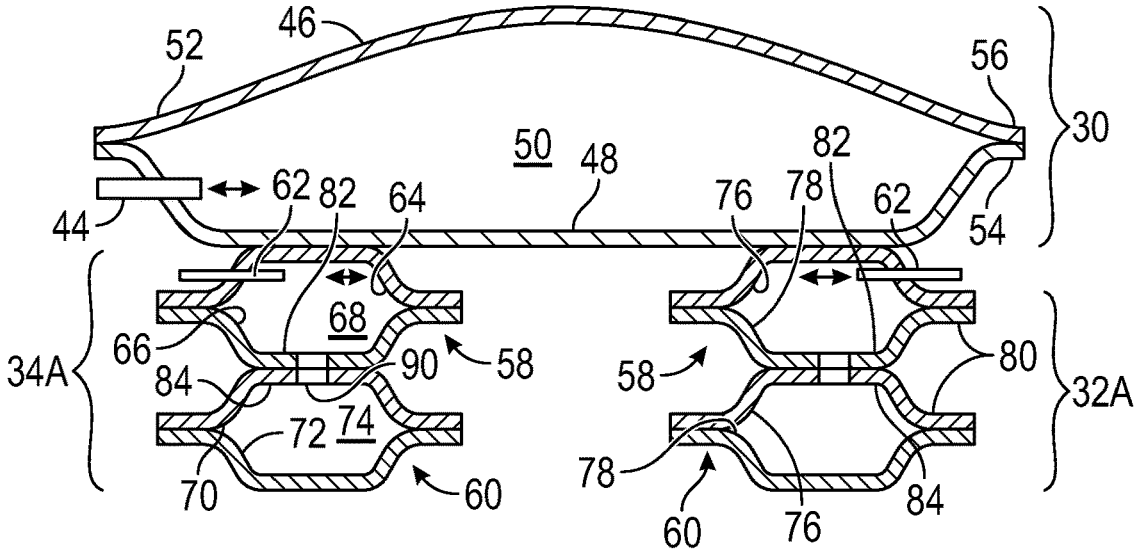
FIG. 3 is a cross section of an inflatable support unit and two inflatable massage units of the pneumatic lounging system taken along lines 3-3 of FIG. 1.
Figure 4:
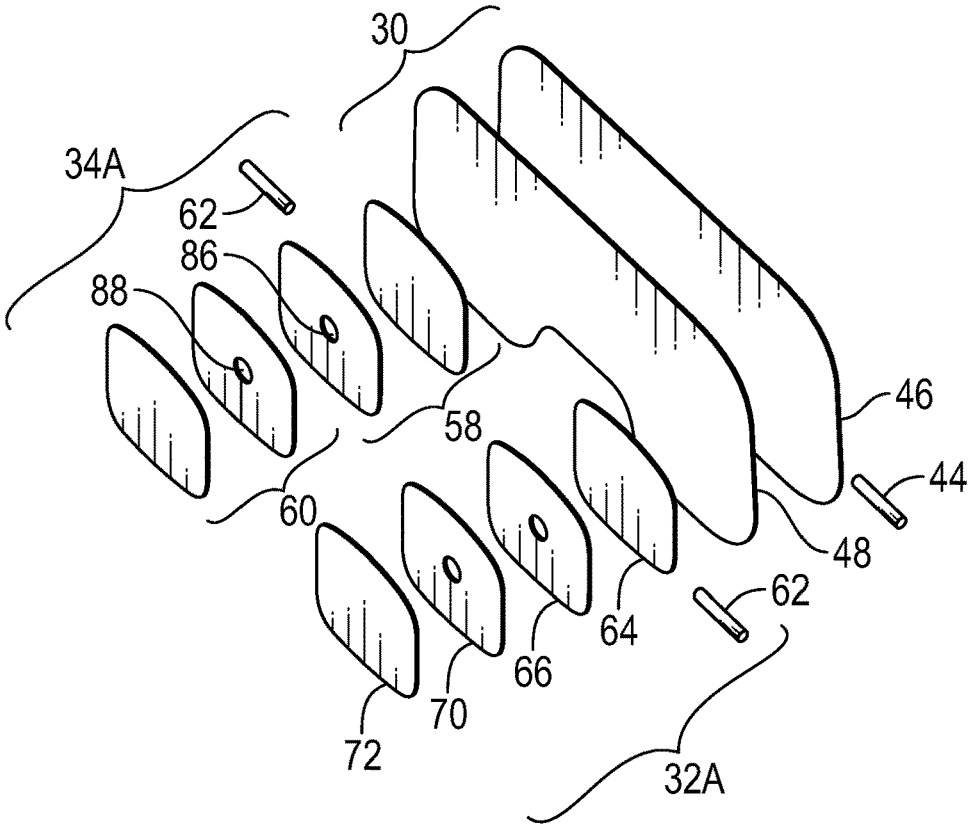
FIG. 4 is an unassembled perspective view of the inflatable support unit and the two inflatable massage units.

Referring to FIGS. 3 and 4, the inflatable support unit 30 includes an air nozzle 44, an inward layer 46 and an outward layer 48. The inward layer 46 may be attached to the front side 42 of the support structure 22. The inward and outward layers 46, 48 define boundaries of an air cavity 50. The air nozzle 44 is adapted to provide fluid communication between a designated air conduit 40 and the air cavity 50 for inflation and/or deflation. In one embodiment, the inward layer 46 includes a circumferentially continuous, outer perimeter, portion 52, and the outward layer 48 includes a circumferentially continuous, outer perimeter portion 54. The two perimeter portions 52, 54 are attached, or otherwise adhered, to form a continuous perimeter seam 56.

Each inflatable massage unit 32A, 34A includes a plurality of stacked air cells (i.e., two illustrated for each as 58, 60) and an air nozzle 62. The air cell 58 is an inward air cell, and the air cell 60 is an outward air cell. Although not specifically illustrated, additional air cells may be located between cells 58, 60. Each massage unit 32A, 34A is generally constructed to inflate and deflate similar to that of an accordion, and is thus accordion like. It is contemplated and understood that one or more of the massage units 32B-E, and/or one or more of the massage units 34B-E may also be accordion-like.

Inward air cell 58 includes an inward wall 64 and an outward wall 66. In one embodiment, the inward wall 64 is attached, or otherwise adhered, directly to the outward layer 48 of the inflatable support unit 30. The inward and outward walls 64, 66 define boundaries of an air chamber 68. The outward air cell 60 includes an inward wall 70 and an outward wall 72. In one embodiment, the inward wall 70 of cell 60 is directly attached to the outward wall 66 of cell 58. The inward and outward walls 70, 72 define boundaries of an air chamber 74.

The inward walls 64, 70 and the respective outward walls 66, 72 include respective outer perimeter segments 76, 78. When the massage units 32A, 34A are fully assembled the outer perimeter segments 76, 78 are attached, or adhered, forming a circumferentially continuous outer perimeter seam 80 of each cell 58, 60.

The outward wall 66 of the inward massage cell 58, and the inward wall 70 of the outward massage cell 60 include respective inner perimeter segments 82, 84 spaced radially inward from the respective outer perimeter segments 78, 76. The inner perimeter segments 82, 84 (i.e., or inner perimeters) are each circumferentially continuous and define respective openings 86, 88 (see FIG. 4) communicating through the respective outward and inward walls 66, 70. When the massage units 32A, 34A are fully assembled, the openings 86, 88 are aligned, and the inner perimeter segments 82, 84 are attached, or adhered. The inner perimeter segments 82, 84, together, define boundaries of an orifice 90 that facilitates the flow of air between the chambers 68, 74.

The layers 46, 48, and walls 64, 66, 70, 72 may be made of resiliently pliable plastic. In one embodiment, the seams 56, 80 may be sonic welded seams.

In operation of the pneumatic lounging system 24, the inflatable support unit 30 may inflate and deflate independent of the massage units 32A, 34A. More specifically, there is no direct fluid communication between the air cavity 50 of the support unit 30 and the air chamber 68 of the inward cell 58 of either massage units 32A, 34A.

In one embodiment, the air nozzle 62 of either massage units 32A, 34A may provide fluid communication directly between a designated conduit 40 and the air chamber 68 of the inward cell 58. During operation, the rate of inflation and/or deflation of the inward cell 58 may be different than the rate of inflation of the outward cell 60. Inflation and deflation rates between chambers may be dictated upon the design sizing of the orifice 90, wall construction, and pressure placed upon the outward wall 72 of the outward cell 60 by an occupant.

Advantages and benefits of the present disclosure include a combined inflatable unit having both support and massage capability that operate independently from one-another. Other advantages include improved packaging and the ability to install the units on an A-side of seat foam, without bother with the B-side of foam. That is, the inflatable support unit need not be placed on the B-side of seat foam.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A pneumatic lounging system comprising:

an inflatable support unit including:

an inward layer and an outward layer defining an air cavity, wherein the outward layer is attached to the inward layer, and a support air nozzle attached and adapted to provide direct fluid communication of air with the air cavity; and a first inflatable unit including:

an inward wall and an outward wall, wherein the inward and outward walls define at least one air chamber and the inward wall is attached to the outward layer, and an air nozzle adapted to provide direct fluid communication of air with one of the at least one air chamber, wherein the fluid communication of air with the air cavity is independent of the fluid communication of air with the at least one air chamber.

2. The pneumatic lounging system set forth in claim 1, wherein the first inflatable unit includes a plurality of stacked air cells each including an inward wall and an outward wall, the inward and outward walls of each air cell defining an air chamber, at least one orifice adapted to provide fluid communication between respective chambers of adjacent air cells of the plurality of stacked air cells.

3. The pneumatic lounging system set forth in claim 2, wherein each orifice of the at least one orifice includes a first inner perimeter defining an opening in an outward wall of an inward air cell and a second inner perimeter defining an opening in an inward wall of an adjacent outward air cell, the first and second perimeters being attached, and the openings being aligned to provide fluid communication between the inward and outward air cells.

4. The pneumatic lounging system set forth in claim 3, wherein the first inflatable unit is accordion-like.

5. The pneumatic lounging system set forth in claim 1, wherein the first inflatable unit is a first inflatable massage unit.

6. The pneumatic lounging system set forth in claim 3, wherein an outer perimeter segment of the inward wall and an outer perimeter segment of the outward wall of each air cell of the plurality of air cells are attached forming a continuous outer perimeter seam.

7. The pneumatic lounging system set forth in claim 3, wherein an outer perimeter portion of the inward layer and an outer perimeter portion of the outward layer are attached forming an outer perimeter layer seam.

8. The pneumatic lounging system set forth in claim 7, wherein an outer perimeter segment of the inward wall and an outer perimeter segment of the outward wall of each air cell of the plurality of air cells are attached forming an outer perimeter wall seam.

9. The pneumatic lounging system set forth in claim 7, wherein the outer perimeter layer seam is sonic welded, and the inward and outward layers are made of resiliently pliable plastic.

10. The pneumatic lounging system set forth in claim 1, further comprising:

a second inflatable unit including:

an inward wall and an outward wall, wherein the inward and outward walls define at least one air chamber and the inward wall is attached to the outward layer, and an air nozzle adapted to provide direct fluid communication of air with one of the at least one air chamber, wherein there is no fluid communication between the inflatable support unit and the second inflatable unit.

11. The pneumatic lounging system set forth in claim 10, wherein the first and second inflatable units are inflatable massage units.

12. The pneumatic lounging system set forth in claim 11, wherein the inflatable support unit is a shoulder support unit and the first and second inflatable massage units are left and right side massage units.

13. The pneumatic lounging system set forth in claim 1, further comprising an automotive seat structure adapted to support the inflatable support unit.

14. An automotive seat comprising:

a seat structure;

an inflatable support unit adapted to adjustably support at least one of a lumbar, a neck, and a shoulder; and a first inflatable unit including:

an inward wall and an outward wall, wherein the inward and outward walls define at least one air chamber and the inward wall is directly attached to the inflatable support unit, and an air nozzle adapted to provide direct fluid communication of air with one of the at least one air chamber, wherein there is no fluid communication between the inflatable support unit and the first inflatable unit.

15. The automotive seat set forth in claim 14, further comprising:

a second inflatable unit laterally spaced from the first inflatable unit, the second inflatable unit including:

an inward wall and an outward wall, wherein the inward and outward walls define at least one air chamber and the inward wall of the second inflatable unit is directly attached to the inflatable support unit, and an air nozzle attached and adapted to provide direct fluid communication of air with one of the at least one air chamber, wherein there is no fluid communication between the inflatable support unit and the second inflatable unit.

16. The automotive seat set forth in claim 15, wherein the first and second inflatable units are massage units.

17. The automotive seat set forth in claim 16, wherein the inflatable support unit is an adjustable shoulder support unit, and the first inflatable massage unit is generally a left shoulder massage unit, and the second inflatable massage unit is generally a right shoulder massage unit.

18. The automotive seat set forth in claim 16, wherein the first and second inflatable units are each accordion-like including a plurality of stacked air cells each defining an air chamber, at least one orifice positioned between adjacent air cells of the plurality of stacked air cells for fluid communication between chambers.

19. The automotive seat set forth in claim 18, wherein the plurality of stacked air cells include an inward air cell attached to the inflatable support unit, and an outward air cell attached to and in fluid communication with the inward air cell.

20. The automotive seat set forth in claim 19, wherein the inflatable support unit includes an inward layer, an outward layer and a support air nozzle, the inward and outward layers defining an air cavity, and the support air nozzle being in fluid communication with the air cavity for the flow of air, and wherein the inward walls of each one of the first and second inflatable units are attached to the outward layer.

* * * * *